United States Patent [19]

Svetlik

[11] 4,347,673

[45] Sep. 7, 1982

[54] DISPLAY SOLES FOR ARTICLES OF FOOTWEAR

[75] Inventor: Joseph F. Svetlik, Stow, Ohio

[73] Assignee: Phillips Petroleum Company, Bartlesville, Okla.

[21] Appl. No.: 203,928

[22] Filed: Nov. 4, 1980

Related U.S. Application Data

[63] Continuation-in-part of Ser. No. 1,035, Jan. 4, 1979, abandoned.

[51] Int. Cl.[3] ..... A43B 13/04; A43B 13/12

[52] U.S. Cl. ..... 36/32 R; 36/30 R; 40/2 E; 525/314; D2/320

[58] Field of Search ..... 36/32 R, 30 R, 25 R; D2/320, 321; 40/2 E; 525/314

[56] References Cited

U.S. PATENT DOCUMENTS

| | | | |
|---|---|---|---|
| 2,419,387 | 4/1947 | Bierer | 36/30 R |
| 3,082,556 | 3/1963 | Schwartz et al. | 40/2 E |
| 3,522,343 | 7/1970 | Chandler et al. | |
| 3,535,418 | 10/1970 | Daum et al. | |
| 3,560,593 | 2/1971 | Hsieh | 525/314 X |
| 3,596,381 | 8/1971 | Fukuoka . | |
| 3,614,836 | 10/1971 | Snyder et al. | |
| 3,675,346 | 7/1972 | Miyachi et al. | |
| 3,778,490 | 12/1973 | Hsieh | 525/314 X |
| 3,823,109 | 7/1974 | Middlebrook | 525/314 X |
| 3,950,292 | 4/1976 | Cooper . | |
| 3,959,895 | 6/1976 | Lonning | 36/32 R |
| 4,006,116 | 2/1977 | Dominguez | 36/32 R |
| 4,049,595 | 9/1977 | Dominguez | 36/32 R |
| 4,050,167 | 9/1977 | Senter . | |

FOREIGN PATENT DOCUMENTS

| | | | |
|---|---|---|---|
| 565059 | 3/1958 | Belgium | 36/30 R |
| 686721 | 5/1964 | Canada | 525/314 |
| 584291 | 1/1947 | United Kingdom | 40/2 E |
| 1433990 | 4/1976 | United Kingdom | 525/314 |

*Primary Examiner*—James Kee Chi

[57] ABSTRACT

A sole for footwear made of thermoplastic of sufficient transparency to permit display of the bottom of the article of footwear to which it is attached. In various embodiments of the invention an at least semitransparent thermoplastic sole is attached to an article of footwear with a patterned insole or inlay adjacent to the top of the sole and protected thereby or with a patterned inlay embedded within the thermoplastic sole. In a preferred embodiment an, at least, semi-transparent composition is provided by a blend of predominantly elastomeric block polymer and predominantly nonelastomeric block polymer with each of the block polymer types chosen from radial and linear block copolymers of conjugated, diene and monovinyl substituted hydrocarbon.

9 Claims, No Drawings

DISPLAY SOLES FOR ARTICLES OF FOOTWEAR

This application is a continuation in part of copending application having Ser. No. 001,035, filed Jan. 4, 1979, now abandoned.

BACKGROUND OF THE INVENTION

This invention relates to footwear. In one of its aspects, this invention relates to soles for articles of footwear. In another of its aspects this invention relates to footwear with shoesoles that are at least semi-transparent. In another of its aspects this invention relates to footwear displaying designs through the soles.

It is known in the prior art to provide decorations, embossed figures, serrations, and the like on and in the soles of footwear. It is also known to place a three-dimensional inset figure in a recessed area of the sole, so that the exposed surface is substantially flush with the walking surface of the sole. While these decorations may provide a better grip in walking, they may also unnecessarily increase the height of the footwear, may cause slippage, or may be objectionable for other reasons. It is therefore an object of this invention to provide a shoesole that is sufficiently transparent that decorations can be seen through the sole while being protected by the sole. It is another object of this invention to provide an article of footwear having a sole of sufficient transparency that decorations within the sole itself or formed on the botton of the shoe above the sole can be displayed through the sole.

Other aspects, objects, and the various advantages of this invention will become apparent from reading this disclosure and the appended claims.

STATEMENT OF THE INVENTION

According to this invention there is provided a thermoplastic sole for footwear in which the sole is of sufficient transparency to permit display of the bottom of the article of footwear to which it is attached.

In an embodiment of this invention an article of footwear is provided in which a thermoplastic sole, as described above, is attached to the footwear article with the sole adjacent to a patterened insole so that the pattern shows through the sole and is protected by the sole. Similarly, a patterned inlay can be positioned between the thermoplastic sole and the insole or a patterned inlay can be embedded within the thermoplastic sole.

The invention concerns footwear constructed entirely or in part from a thermoplastic elastomer or a thermoplastic resin. It is particularly directed to casual footwear as sandals, clogs, tennis shoes, etc. A charasteristic feature of the footwear is the sole which is substantially transparent or at least semi-transparent through which an internally positioned pattern is clearly visible. The pattern can be in the form of a separate sheet or inlay which is located between the sole and insole or it can form the bottom portion of the insole itself. By virtue of the location of the pattern, its identity is preserved since it is not exposed to wear or the elements. Moreover, the nature of the pattern can be changed when desired by replacing it with another inlay or insole having a different pattern. The sole can be colorless or tinted any desirable color providing its transparency is not significantly obscured by the colorant employed. Suitable colorants include dyes and pigments having good transparency characteristics such as the phthalocyanine blues and greens, quinacridone pigments in gold, orange, reds, and violet, and fluorescent pigments in many colors. The colorants are commercially available materials.

The patterns contemplated in this invention include geometric designs, abstract designs, animals and birds and parts thereof such as heads, talons, claws, paws, etc., human figures and parts thereof such as heads, hands, feet, etc., numbers, letters, names, and the like. The patterns can be created by a simulation of the material that constitutes the uppers of the footwear or the same material that constitutes the uppers can be arranged to show through the thermoplastic sole. The invention contemplates the use of such widely varying materials as natural rubber, opaque thermoplastics, woven fabric, metallic threads and objects, and any naturally occurring material that can be incorporated into an interesting display.

Any normally solid thermoplastic elastomer possessing suitable strength, toughness, and the requisite transparency when molded can be used in the practice of this invention. Presently preferred thermoplastic elastomers include the radial and linear block copolymers prepared from a conjugated diene containing from about 4 to 12 carbon atoms per molecule and a monovinyl-substituted hydrocarbon containing from about 8 to 18 carbon atoms per molecule.

The linear block copolymers can be broadly described as A-B-A-type polymers where A represents a polymer segment having nonelastomeric properties and B represents an elastomeric polymer segment. When the preparative method includes a polyfunctional treating agent containing two functional groups, the linear block copolymers can also be depicted as A-B-Y-B-A where A and B are as defined before and Y is representative of an atom or group of atoms derived from the treating agent.

Particularly preferred thermoplastic elastomers include the radial block copolymers described by the formulas $(A\text{-}B)_xY$ or $(A\text{-}B\text{-}A)_xY$ where A, B, and Y are as defined before and x represents the number of functional groups of the treating agent and is at least 3.

The nonelastomeric segments comprise from about 20 to 80 weight percent of the total weight of the linear and radial block copolymers and the elastomeric segment comprises from about 80 to 20 weight percent. It can be seen that by adjusting the relative amount of elastomeric and nonelastomeric segments that either a predominantly elastomeric or a predominantly nonelastomeric copolymer can be produced.

Especially suitable radial block copolymers are prepared from 1,3-butadiene and styrene using a primary hydrocarbyl-lithium initiator, an inert hydrocarbon diluent, and a polar compound adjuvant as disclosed in U.S. Pat. No. 3,778,490. As disclosed in that patent, high green tensile strength predominantly elastomeric block polymers, produced by the process disclosed, are suitable for such service as the production of shoe soles. Similarly, predominantly nonelastomeric block polymers can be produced which have transparency as a characteristic. It has now been discovered that by blending copolymers of the elastomeric type with a sufficient amount of transparent copolymer of the nonelastomeric type a composition retaining the good wear characteristics of the elastomeric copolymer and the transparency of the nonelastomeric copolymer can be produced. Suitable ratios of elastomeric/nonelastomeric copolymers usually fall within a range of about 80/20 to about 40/60 parts by weight, preferably about 70/30 to about 50/50 parts by weight.

The radial block copolymers can be admixed with various commercially available compounding materials, if desireable, providing that the transparency of articles molded from the resulting compositions is not materially diminished. Such materials include stabilizers, e.g., 2,6-di-t-butyl-4-methylphenol, 2,2'-methylene-bis(4-methyl-6-t-butylphenol), octadecyl[3-(3,5-di-t-butyl-4-hydroxyphenyl)]propionate, thiodiethylene bis(3,5-di-butyl-4-hydroxy)hydrocinnamate, dilauryl thiodipropionate, and the like, ultraviolet absorbers, e.g., 2-hydroxy-4-n-octyloxybenzophenone, 2-(2'-hydroxy-5'-methylphenyl)benzotriazole, p-octylphenyl salicylate, and the like, organic phosphites, e.g., dioctyl phosphite, trisnonylphenylphosphite, and the like, processing aids such as calcium stearate, zinc stearate, amide waxes, e.g., stearamide, ethylene glycol, polyethylene glycol, triethanolamine, and the like, blowing agents such as azobisformamide, 4,4'-oxybis(benzene-sulfonyl hydrazide), and the like, and mixtures thereof. Other compounding ingredients include paraffinic, aromatic, and naphthenic oils and mixtures thereof, normally solid resinous homopolymers of vinyl-substituted aromatic compounds and copolymers of vinyl-substituted aromatic compounds with various monomers such as acrylonitrile, butadiene, and the like. Exemplary resinous compounds include polystyrene, poly(α-methylstyrene), styrene-acrylonitrile copolymers, linear and radial styrene-butadiene block copolymers, and the like, and mixtures thereof.

Any normally solid thermoplastic resin having suitable strength, toughness, and transparency when molded can also be used in the practice of this invention. Suitable for this purpose are vinyl chloride polymers, e.g., polyvinyl chloride, containing sufficient plasticizer to provide enough flexibility for the footwear use intended. Suitable compositions can be prepared from blending, calendering, extrusion, and dispersion grades of polyvinyl chloride mixed or compounded with about 50 to 80 parts by weight per 100 parts by weight resin (php) or an ester-type primary plasticizer such as dioctyl phthalate, stabilizers ranging from about 0.5–10 php including dibutyltin dilaurate, dibutyltin maleate, etc., trisnonylphenylphosphite, dilauryl-phosphite, etc., phenyl salicylate, 2-(2'-hydroxy-5'-methylphenyl)benzotriazole, etc., transparent colorants, e.g., phthalocyanine green, and the like.

The vinyl chloride polymer-containing compositions can be converted into soling material by calendering, injection molding and slush casting processes as known in the art.

Presently preferred polymers for use in the preparation of the footwear are the normally solid linear and radial butadiene/styrene block copolymers having a thermoplastic elastomeric nature as previously disclosed. A combination of polymers falling within this group can be employed, if desired.

Representative compositions containing the above block copolymers based on 100 parts by weight thermoplastic elastomer or, in the case of blends of elastomeric and nonelastomeric copolymers based on 100 parts by weight of total block copolymer, can include blowing agents, stabilizers, ultraviolet absorbers and processing aids, ranging from about 0.01 to 5 parts by weight, oils from 0 to about 100 parts by weight, silica from 0 to about 20 parts by weight, polystyrene from 0 to about 50 parts by weight, colorants from 0 to about 3 parts by weight, and poly(α-methylstyrene) from 0 to about 50 parts by weight.

The compositions can be mixed together following conventional practices including dry blending followed by intensive blending in high speed mixers, e.g., Henschel mixers, Banbury mixers, roll mills, compounding extruders, and the like.

The resulting compositions after recovery can be extruded, injection molded, flow molded, etc., to form sheets, preforms, and the like. Footwear can be formed from the resulting products by adhesive or hot melt bonding or sewing them to other footwear components such as uppers, insoles, and the like. Integrally molded sandals, etc., can be formed from the compositions by utilizing injection molding and thermoforming techniques as are known in the art. Suitable processes employed in forming the footwear include those disclosed in U.S. Pat. Nos. 3,522,343; 3,535,418; 3,596,381; 3,614,836; and 3,675,346. These processes, however, do not constitute any part of this invention.

To demonstrate that transparent or semi-transparent molded articles can be formed from compositions comprising blends of thermoplastic elastomeric and nonelastomeric butadiene/styrene radial block copolymers, the following compositions were prepared, all expressed in parts by weight.

| | Composition A | Composition B |
|---|---|---|
| Copolymer 1 | 25 | 25 |
| Copolymer 2 | 15 | 15 |
| Copolymer 3 | 60 | 60 |
| Naphthenic oil | 42.5 | 46 |
| Stabilizer 1 | 0.3 | 0.3 |
| Stabilizer 2 | 0.3 | 0.3 |
| Stabilizer 3 | 0.2 | 0.2 |
| Colloidal silica | 0 | 10 |
| Total | 143.3 | 156.8 |

After compounding in a Banbury mixer, each composition was granulated, molded into test slabs of about 6×6×0.25 inches (15×15×0.6 cm), and visually inspected for transparency. Composition A gave substantially transparent moldings and Composition B gave semi-transparent to translucent moldings.

The results indicate that these thermoplstic elastomer compositions are transparent enough to allow designs and patterns to show through so that the compositions are suitable for the soles of footwear according to this invention.

I claim:

1. A thermoplastic sole for footwear said sole of sufficient transparency to permit display of the bottom of the article of footwear to which it is attached said thermoplastic comprising a blend of (1) predominantly elastomeric block polymer with (2) an amount of predominantly nonelastomeric block polymer sufficient to provide transparency to said blend, said block polymers chosen from among the group consisting of radial and linear block copolymers prepared from a conjugated diene containing from about 4 to 12 carbon atoms per molecule and a monovinylsubstituted hydrocarbon containing from about 8 to 18 carbon atoms per molecule wherein said radial block copolymers consist essentially of polymers described by the formulas $(A\text{-}B)_xY$ or $(A\text{-}B\text{-}A)_xY$ wherein A represents a polymer segment having nonelastomeric properties, B represents an elastomeric polymer segment, Y represents an atom or group of atoms derived from a polyfunctional treating agent, and x represents the number of functional groups of the treating agent and is at least 3 and said linear block copolymers consist essentially of polymers described as A-B-A or A-B-Y-B-A wherein A represents a polymer segment having nonelastomeric properties, B represents an elastomeric polymer segment, and Y represents an atom or group of atoms derived from a polyfunctional treating agent.

2. A thermoplastic sole of claim 1 comprising a patterned inlay embedded within said thermoplastic sole.

3. An article of footwear comprising the thermoplastic sole of claim 1 attached to said article, said sole adjacent to a patterned insole so that the pattern shows through the sole.

4. An article of footwear comprising a thermoplastic sole of claim 1 attached to said article with a patterned inlay positioned between said thermoplastic sole and the insole of said article.

5. An article of footwear comprising a thermoplastic sole of claim 2.

6. A thermoplastic sole of claim 1 wherein said block polymers consist essentially of radial block copolymers described by the formulas $(A\text{-}B)_xY$ or $(A\text{-}B\text{-}A)_xY$ wherein A represents a polymer segment having nonelastomeric properties, B represents an elastomeric polymer segment, Y represents an atom or group of atoms derived from a polyfunctional treating agent, and x represents the number of functional groups of the treating agent and is at least 3.

7. An article of footwear comprising a thermoplastic sole of claim 6.

8. A thermoplastic sole of claim 1 wherein said block polymers consist essentially of linear block copolymers described as A-B-A or A-B-Y-B-A wherein A represents a polymer segment having nonelastomeric properties, B represents an elastomeric polymer segment, and Y represents an atom or group of atoms derived from a polyfunctional treating agent.

9. An article of footwear comprising a thermoplastic sole of claim 8.

* * * * *